United States Patent [19]

Streit

[11] 4,335,346

[45] Jun. 15, 1982

[54] TEMPERATURE INDEPENDENT VOLTAGE SUPPLY

[75] Inventor: Klaus Streit, Tubingen, Fed. Rep. of Germany

[73] Assignee: Robert Bosch GmbH, Stuttgart, Fed. Rep. of Germany

[21] Appl. No.: 235,757

[22] Filed: Feb. 18, 1981

[30] Foreign Application Priority Data

Feb. 22, 1980 [DE] Fed. Rep. of Germany ..... 3006598

[51] Int. Cl.[3] ..... G05F 3/20

[52] U.S. Cl. ..... 323/313; 307/297; 323/907

[58] Field of Search ..... 307/296 R, 297; 323/312–315, 907

[56] References Cited

U.S. PATENT DOCUMENTS

| | | | |
|---|---|---|---|
| 3,831,040 | 8/1974 | Nanba et al. | 307/296 |
| 4,150,309 | 4/1979 | Tokuda | 307/297 X |
| 4,260,946 | 4/1981 | Wheatley, Jr. | 307/297 X |
| 4,263,544 | 4/1981 | Groendijk | 323/907 X |

OTHER PUBLICATIONS

IEEE Journal of Solid-State Circuits, vol. SC-11, No. 6, p. 795, Dec. 1976.

*Primary Examiner*—William M. Shoop

*Attorney, Agent, or Firm*—Frishauf, Holtz, Goodman & Woodward

[57] ABSTRACT

The current flowing through a reference resistor constitutes the temperature independent output voltage. This current consists of the sum of a first and second current. The first current is a current which is proportional to absolute temperature and has an amplitude which depends on the value of the first resistor. The second current is proportional to the base-emitter voltage of a transistor and its amplitude depends on the value of the second resistor. The values of the first and second resistor are fixed so that the temperature coefficient of the current flowing through the reference resistor is zero. Specifically, one end of the reference resistor is connected to one side of the operating voltage source while the other side is connected through a series circuit including the emitter-collector circuit of the first transistor and the first resistor to ground potential. A second circuit is connected in parallel with the first circuit. The second circuit consists of the emitter-collector circuit of a second transistor and the second resistor. A semiconductor voltage divider has a first and second tap connected to the base of the first and second transistor, respectively. A constant current is supplied to the voltage divider, either by a constant current source or by a circuit mirroring the current flow through the reference resistor. The values of the first and second resistor are fixed so that the temperature coefficient of the current flowing through the reference resistor is zero.

8 Claims, 2 Drawing Figures

TEMPERATURE INDEPENDENT VOLTAGE SUPPLY

CROSS-REFERENCE TO RELATED PUBLICATIONS AND APPLICATIONS (1) IEEE Journal of Solid-State Circuits, Vol. SC-11, No. 6, Page 795, December 1976.

The present invention relates to voltage supplies and, more particularly, to voltage supplies which furnish an output voltage which is independent of temperature.

BACKGROUND OF THE INVENTION

In a well known temperature compensated voltage supply, the difference between two base-emitter voltages is added to a third base-emitter voltage. When the values of the components of the circuit are correctly chosen, a reference voltage results which is substantially independent of temperature. However, this voltage has a fixed value, namely the value of the bandgap voltage. It is thus not possible with this type of circuit to choose a value of the output or reference voltage.

A reference current source is described in IEEE Journal of Solid-State Circuits, Vol. SC-11, No. 6, Page 798. This includes two transistors having different emitter areas. Two identical resistors and a difference amplifier cause the two collector currents to be equal. The voltage across the base-emitter circuit of one of the transistors is inversely proportional to absolute temperature. This voltage is applied across a resistor so that a current also proportional to absolute temperature results. A second current is proportional to the base-emitter voltage of the other transistor and flows over another resistor. The sum of the two currents, when correctly proportioned, is substantially independent of temperature. However, this circuit requires a relatively high operating voltage, a relatively large amount of equipment and, finally, constitutes a closed loop circuit whose stability must be assured by additional components.

THE INVENTION

It is an object of the present invention to furnish a temperature independent voltage supply which requires a lesser operating voltage. It is further to be simpler in construction than the known circuit. The requirements for keeping the current from the current source constant are to be decreased. Finally, the circuit is to be an open loop circuit so that additional components for stabilization will not be required.

The temperature compensated voltage is the voltage drop across a reference resistor. The current through the reference resistor is the sum of a first and second current. The first current is the emitter-collector current of a first transistor connected to the reference resistor and connected to ground through a first resistor. The second current is a collector current of a second transistor also connected to the reference resistor and connected to ground potential through a second resistor. A semiconductor voltage divider has a first tap connected to the base of the first transistor and the second tap connected to the base of the second transistor. A constant current flows through the voltage divider. Correct dimensioning of the first and second resistor causes the current through the reference resistor to be substantially independent of temperature.

DESCRIPTION OF THE PREFERRED EMBODIMENT

Figure 1:
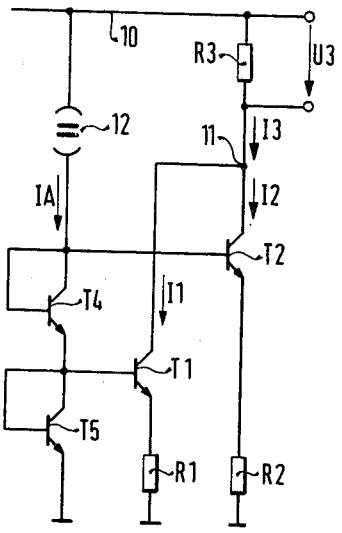
FIG. 1 is a circuit diagram of an embodiment of the present invention utilizing a constant current source; and, FIG. 2 is a circuit diagram of an alternate embodiment utilizing a mirroring circuit to supply current through the voltage divider.

In the circuit of FIG. 1, the operating voltage is applied between a reference potential such as ground potential and a line 10. A reference resistor R3 is connected to line 10. The voltage U3 developed across resistor R3 is the output voltage of the circuit. A current I3 flows through resistor R3. Further, resistor R3 is connected to a node 11 which is connected to the collectors of transistors T1 and T2. The corresponding collector currents are denoted by I1 and I2. The emitters of transistors T1 and T2 are connected to ground potential through resistors R1 and R2, respectively. A constant current source 12 is connected to line 10. The other side of constant current source 12 is connected to a voltage divider including two transistors, namely transistors T4 and T5. The base electrodes of transistors T4 and T5 are connected to their respective collectors. The base of transistor T1 is connected to one voltage divider tap, namely the common point of the emitter of transistor T4 and the collector of transistor T5, while the base of transistor T2 is connected to a second voltage divider tap, namely the collector of transistor T4. The current through constant current source 12 is denoted by $I_A$.

Diodes could be subtituted for transistors T4 and T5. The voltage divider utilizing transistors is, however, more suitable for integrated circuit embodiments. Preferably, resistors R1, R2 and R3 are also part of the integrated circuit, so that the temperature coefficients of these resistors have no effect on the overall circuit. If resistors R1, R2 and R3 are discrete building elements, these resistors must be of identical construction and subjected to the same operating conditions if a constant temperature output voltage is to be achieved.

OPERATION

The circuit shown in FIG. 1 operates as follows: The current I3 through reference resistor R3 consists of the sum of currents I1 and I2. Therefore:

$$I_3 = I_1 + I_2 \tag{1}$$

The current I1 is to be made proportional to the absolute temperature T, while the current I2 is to be made proportional to a base-emitter voltage $U_{BE}$. Since:

$$U_T = \frac{kT}{e_o} \tag{2}$$

where k = Boltzmann constant

T = absolute temperature $e_o$ = elementary charge

Commonly the base-emitter voltage of a transistor with collector current Ic is:

$$U_{BE} = U_T \ln Ic/Is \tag{3}$$

where Is is the so called saturation current follows:

$$I_1R_1 = U_{BE5} - U_{BE1} = U_T \ln I_A/I_s - U_T \ln I_1/I_s \quad (4)$$

where $U_{BE5}$ and $U_{BE1}$ are the base-emitter voltages of transistors T5, T1, respectively. Follows:

$$I_1 = U_T/R_1 \cdot \ln I_A/I_1 \quad (5)$$

For current $I_2$ a different relationship exists since the base-emitter voltage of transistor T2 and the base-emitter voltages of transistors T4 and T5 are involved. Specifically:

$$I_2 R_2 = U_{BE5} + U_{BE4} - U_{BE2} \quad (6)$$

or, with $U_{BE5} = U_{BE4} = U_{BE(IA)}$ and $U_{BE2} = U_{BE(Is)}$:

$$I_2 = 1/R_2\,[2U_{BE}(I_A) - U_{BE}(I_2)] \quad (7)$$

$$U_{BEo} = U_{BE}(I_o, T);\ I_o = 100\ \mu A\ \text{(p.e.)} \quad (8)$$

$$I_2 = 1/R_2\,(U_{BEo} + 2\,U_T \ln I_A/I_o - U_T \ln I_2/I_o) \quad (9)$$

$$I_2 = 1/R_2\,(U_{BEo} + U_T \ln I_A^2/I_oI_2) \quad (10)$$

The output voltage is $U_3$ where:

$$U_3 = R_3\,I_3 \quad (11)$$

Substituting equations 1, 2 and 10 in equation 11, the following result is obtained:

$$U_3 = R_3/R_2\,[U_{BEo} + U_T(\ln I_A^2/I_oI_2 + R_2/R_1 \cdot \ln I_A/I_1)] \quad (12)$$

A well known equation for the bandgap voltage is as follows:

$$U_{GO} = U_{BEo} + a\,U_T \quad (13)$$

The bandgap voltage is the voltage corresponding to the energy difference between two allowed bands of electron energy in a metal. As noted from the above equation, the bandgap voltage is equal to the sum of two voltages, one of which is proportional to the temperature dependent voltage $U_T$. If the proportionality constant a is so chosen that the over-all temperature coefficient goes to zero, the following equation results:

$$U_{Go} = U_{BEo} + U_T(\ln I_A^2/I_oI_2 + R_2/R_1 \ln I_A/I_1) \quad (14)$$

or $$U_{Go} = U_3\,R_2/R_3 \quad (15)$$

The required resistance value for resistor R2 is then derived as follows:

$$R_2 = R_3\,U_{Go}/U3 \quad (16)$$

The resistance value for resistor R1 is:

$$R_1 = U_T/I_1 \ \ln I_A/I_1 \quad (17)$$

In other words, if the resistance of resistors R1 and R2 is fixed in accordance with the above equations, a temperature coefficient of zero will result for the output voltage.

Figure 2:
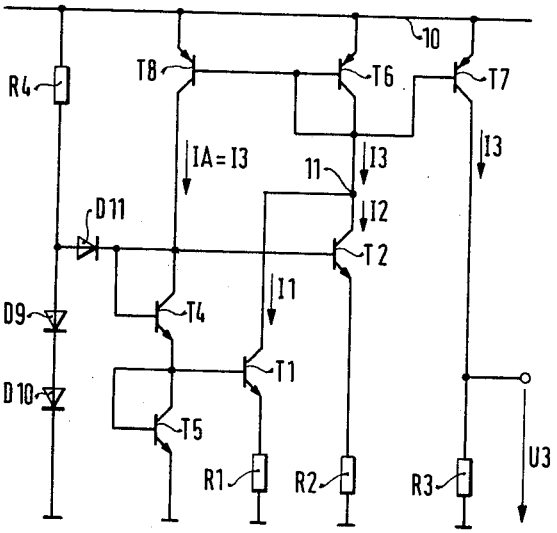

FIG. 2 shows an alternate embodiment of a circuit according to the present invention. It differs from the circuit shown in FIG. 1 in that the constant current $I_A$ is not furnished by a separate constant current source, but is derived as the mirror image of output current I3. The current I3 which flows to node 11 passes through the emitter-collector circuit of a transistor T6 which is connected as a diode. Because of the direct connection of node 11 to the base of transistors T6 and T8, current I3 is mirrored in the collector circuit of transistor T4. The constant current $I_A$ thus corresponds to output current I3, increasing the tendency of current I3 to remain constant. Also shown in FIG. 2 is a starting circuit consisting of resistor R4 and diodes D9, D10, and D11. Diodes D9, D10 and D11 can of course be replaced by transistors connected in the same way as transistors T4, T5 and T6.

Various changes and modifications may be made within the scope of the inventive concepts.

I claim:

1. Circuit for generating a temperature independent output voltage, comprising means for supplying an operating voltage;

a reference resistor (R3) connected to said operating voltage supply means;

a first and second transistor respectively having a first and second emitter-collector circuit connected to said reference resistor and a first and second base;

a first and second resistor (R1, R2) respectively connecting said first and second emitter-collector circuit to reference potential;

voltage divider means (T4, T5) having a first and second voltage divider tap respectively connected to said base of said first and second transistor, and means for creating a constant current flow through said voltage divider means.

2. Circuit as set forth in claim 1, wherein said first resistor (R1) has a resistance:

$$R_1 = U_T/I_1 \ \ln I_A/I_1$$

and wherein the resistance of said second resistor (R2) is:

$$R_2 = R_3\,U_{Go}U_3$$

where $U_T$ is the temperature dependent voltage, I1 is the current through said first resistor, $I_A$ the constant current flowing through said voltage divider means, $U_{Go}$ the bandgap voltage and $U_3$ the temperature independent output voltage.

3. A circuit as set forth in claim 2, wherein said means for creating a constant current flow through said voltage divider means comprises a constant current source connected in series with said voltage divider means.

4. A circuit as set forth in claim 2, wherein said means for creating a constant current flow through said voltage divider means comprises a mirroring circuit for driving a constant current equal to said output current through said voltage divider means.

5. A circuit as set forth in claim 1, wherein said voltage divider means comprises a first and second diode.

6. A circuit as set forth in claim 1, wherein said voltage divider means comprises a first and second transistor (T4, T5) each having a base directly connected to the respective collector.

7. A circuit as set forth in claim 1, wherein first, second and reference resistors are integrated circuit resistors.

8. A circuit as set forth in claim 1, wherein said first, second and reference resistors are discrete elements of the same type and are subjected to the same operating conditions.

* * * * *